US011011150B2

(12) United States Patent
Jia et al.

(10) Patent No.: US 11,011,150 B2
(45) Date of Patent: May 18, 2021

(54) ELECTRONIC DEVICE AND METHOD FOR ELIMINATING NOISES FROM RECORDINGS

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Shi Jia, Zhengzhou (CN); Jun-Wei Zhang, Zhengzhou (CN); Jun Zhang, Shenzhen (CN); Yi-Tao Kao, New Taipei (TW)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/573,158

(22) Filed: Sep. 17, 2019

(65) Prior Publication Data

US 2020/0211525 A1 Jul. 2, 2020

(30) Foreign Application Priority Data

Dec. 27, 2018 (CN) ..... 201811614776.7

(51) Int. Cl.
*G10K 11/178* (2006.01)

(52) U.S. Cl.
CPC .... *G10K 11/17827* (2018.01); *G10K 11/1787* (2018.01)

(58) Field of Classification Search
CPC ..... G10K 11/178; G10K 11/17827; G10K 11/1787; G10K 2210/1291; G10K 2210/129; G10K 11/16; G10K 2210/119; G10L 2021/0208; G10L 2021/02082; G10L 21/0272; G10L 25/84; G10L 21/0316; G10L 25/78; H04R 3/02; H04R 1/2807; H04R 1/2869; H04R 2400/03; H04R 2410/05; G01H 1/00
USPC ..... 381/71.1–71.3, 71.8–71.9, 73.1, 97, 110, 381/122, 162, 372; 181/206, 207, 175; 379/392.01; 455/570
See application file for complete search history.

(56) References Cited

U.S. PATENT DOCUMENTS 7,761,106 B2 * 7/2010 Konchitsky ..... H04R 1/406 455/501
2007/0021958 A1 * 1/2007 Visser ..... G10L 21/0272 704/226

(Continued)

*Primary Examiner* — Norman Yu
(74) *Attorney, Agent, or Firm* — ScienBiziP, P.C.

(57) ABSTRACT

A method for eliminating noises collected by an electronic device when voice recordings are being taken detects whether the electronic device is in a voice recording mode. A first acquiring device is controlled to acquire the speaking voices of at least one user, when determining that the electronic device is in the voice recording mode. A determination is made as to whether the speaking voices of at least one user acquired by the first acquiring device include noises produced by the vibration device, and eliminating noises produced by the vibration device, when the speaking voices of at least one user acquired by the first acquiring device include the noises produced by the vibration device.

18 Claims, 2 Drawing Sheets

(56) References Cited

U.S. PATENT DOCUMENTS

| | | | | |
|---|---|---|---|---|
| 2011/0130176 | A1* | 6/2011 | Magrath | G10K 11/178 455/570 |
| 2015/0310845 | A1* | 10/2015 | Chan | G10K 11/175 381/71.8 |
| 2016/0034057 | A1* | 2/2016 | Ikeda | H04M 1/03 345/173 |
| 2018/0012585 | A1* | 1/2018 | Qiao | G10K 11/178 |

* cited by examiner

ELECTRONIC DEVICE AND METHOD FOR ELIMINATING NOISES FROM RECORDINGS

CROSS-REFERENCE TO RELATED APPLICATIONS

This application claims priority to Chinese Patent Application No. 201811614776.7 filed on Dec. 27, 2018, the contents of which are incorporated by reference herein.

FIELD

The subject matter herein generally relates to audio processing technology, and particularly to an electronic device and a method for eliminating noises from recordings.

BACKGROUND

Instant interaction technology allows users more interested in voice calls in instant messaging than in making telephone calls to use software such as WECHAT. When using instant messaging software for the voice calls, noise made by poor hardware quality of electronic devices can lower audio quality. For example, the noise produced by vibration of the electronic device itself can be recorded, and the voice quality is thus affected.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
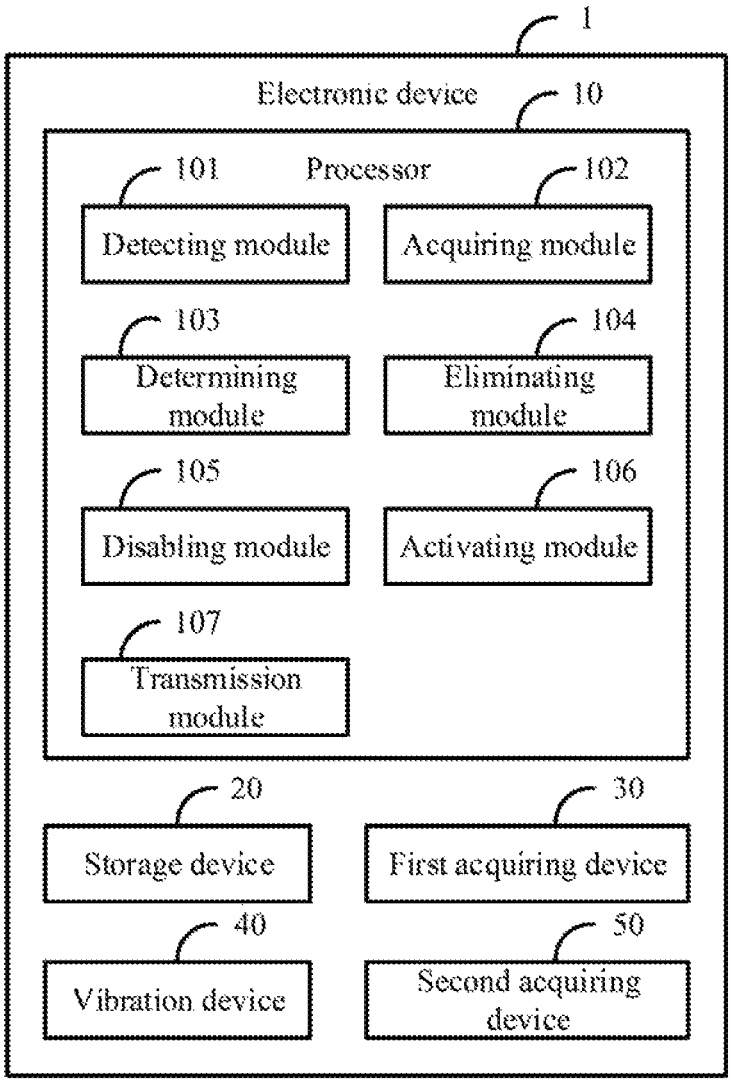
FIG. 1 is a block diagram of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one."

Furthermore, the term "module", as used herein, refers to logic embodied in hardware or firmware, or to a collection of software instructions, written in a programming language, such as, Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY, flash memory, and hard disk drives. The term "comprising" means "including, but not necessarily limited to"; it specifically indicates open-ended inclusion or membership in a so-described combination, group, series, and the like.

FIG. 1 illustrates an embodiment of an electronic device 1. In at least one embodiment, the electronic device 1 can be a smart phone, a personal computer, or a PDA (Personal Digital Assistant). The electronic device 1 includes, but is not limited to, a processor 10, a storage device 20, a first acquiring device 30, a vibration device 40, and a second acquiring device 50. FIG. 1 illustrates only one example of the electronic device 1, other examples can include more or fewer components than illustrated, or have a different configuration of the various components in other embodiments.

The processor 10 can be a central processing unit (CPU), a microprocessor, or other data processor chip that performs functions of the electronic device 1.

In at least one embodiment, the storage device 20 can include various types of non-transitory computer-readable storage mediums. For example, the storage device 20 can be an internal storage system, such as a flash memory, a random access memory (RAM) for temporary storage of information, and/or a read-only memory (ROM) for permanent storage of information. The storage device 20 can also be an external storage system, such as a hard disk, a storage card, or a data storage medium.

In at least one embodiment, the first acquiring device 30 can be a microphone. The first acquiring device 30 can acquire voices.

In at least one embodiment, the vibration device 40 can be an eccentric gear which at least includes an electric motor and a cam. The vibration device 40 can vibrate as an alert.

In at least one embodiment, the second acquiring device 50 can also be a microphone. The second acquiring device 50 is arranged on the vibration device 40, and is used for acquiring sound when the vibration device 40 is working.

As illustrated in FIG. 1, the electronic device 1 at least includes a detecting module 101, an acquiring module 102, a determining module 103, an eliminating module 104, a disabling module 105, an activating module 106, and a transmission module 107. The modules 101-107 can be collections of software instructions stored in the storage device 20 of the electronic device 1 and executed by the processor 10. The modules 101-107 also can include functionality represented as hardware or integrated circuits, or as software and hardware combinations, such as a special-purpose processor or a general-purpose processor with special-purpose firmware.

The detecting module 101 is used to detect whether the electronic device 1 is in a voice recording mode.

In at least one embodiment, the detecting module 101 determines whether the electronic device 1 is in the voice recording mode by detecting whether a voice recording function of the electronic device 1 is activated.

In detail, a number of applications are installed in the electronic device 1. Certain applications with a voice recording function provide at least one voice recording option, when the at least one voice recording option of one of the certain applications is selected by the user, the voice recording function of the electronic device 1 is activated.

For example, the certain applications include WECHAT, voice memo, SKYPE etc. The at least one voice recording option can include a voice input option, a voice call option, and a video call option in the WECHAT application.

The acquiring module 102 is used to control the first acquiring device 30 to acquire speaking voices of at least one user, when the detecting module 101 determines that the electronic device 1 is in the voice recording mode.

In at least one embodiment, the speaking voices acquired by the first acquiring device 30 can be from a user or different users.

In at least one embodiment, the acquiring module 102 can also acquire sound in the environment, and such environmental sound will be mixed in the speaking voices of at least one user.

The determining module 103 is used to determine whether the speaking voices of at least one user acquired by the first acquiring device 30 include noises produced by the vibration device 40.

In at least one embodiment, the determining module 103 determines whether the speaking voices of at least one user acquired by the first acquiring device 30 include the noises produced by the vibration device 40 by determining whether the second acquiring device 50 has acquired sound produced by the vibration device 40. When determining that the second acquiring device 50 has acquired the sound produced by the vibration device 40, the determining module 103 further determines that the speaking voices of at least one user acquired by the first acquiring device 30 include the noises produced by the vibration device 40. When determining that the second acquiring device 50 has not acquired any sound produced by the vibration device 40, the determining module 103 further determines the speaking voices of at least one user acquired by the first acquiring device 30 do not include the noises produced by the vibration device 40.

The eliminating module 104 is used to eliminate the noises produced by the vibration device 40, when the determining module 103 determines that the speaking voices of at least one user acquired by the first acquiring device 30 include the noises produced by the vibration device 40.

In at least one embodiment, the eliminating module 104 controls the first acquiring device 30 to convert the speaking voices of the at least one user mixed with the noises to digital signals, and acquires the digital signals of the speaking voices of the at least one user mixed with the noises. The eliminating module 104 further controls the second acquiring device 50 to convert the noises produced by the vibration device 40 to digital signals, and acquires the digital signals of the noises produced by the vibration device 40.

The eliminating module 104 further analyzes the digital signals of the noises converted by the second acquiring device 50 to determine an amplitude and a phase of the noises, and generates an audio signal with an amplitude which is equal to the determined amplitude and a phase which is contrary to the determined phase. The generated audio signal is superimposed over the digital signal of the noises, so as to cancel the digital signals of the noises mixed in the digital signals of speaking voices of the at least one user.

In another embodiment, the eliminating module 104 can also enable subtraction of the digital signals of speaking voices of the at least one user mixed with the digital signals of noises acquired by the first acquiring device 30 from the digital signals of noises acquired by the second acquiring device 50, the digital signals of noises mixed in the digital signals of speaking voices of the at least one user are thus eliminated. The eliminating module 104 can further amplify the digital signals of speaking voices of the at least one user after the subtraction.

For example, the digital signal $V_1$ of speaking voices mixed with noises acquired by the first acquiring device 30 satisfies following equation 1:

$$V_1=V_{a1}+V_{a2} \tag{1}$$

In the equation 1, $V_{a1}$ is the digital signal of speaking voices acquired by the first acquiring device 30, $V_{a2}$ is the digital signal of noises acquired by the first acquiring device 30.

Furthermore, the digital signal $V_2$ of noises acquired by the second acquiring device 50 satisfies following equation 2:

$$V_2=V_{b1}+V_{b2} \tag{2}$$

In the equation 2, $V_{b1}$ is the digital signal of speaking voices acquired by the second acquiring device 50, $V_{b2}$ is the digital signal of noises acquired by the second acquiring device 50.

The eliminating module 104 calculates the digital signal V of speaking voices without the digital signal of noises using following equation 3:

$$V=n*(V_1-V_2)=n*(V_{a1}+V_{a2}-V_{b1}-V_{b2}) \tag{3}$$

In the equation 3, n is a multiple value of differential amplification, $V_{a2}$ is approximately equal to $V_{b2}$.

In another embodiment, the electronic device 1 can also eliminate the noises produced by the vibration device 40 by software processing. In the embodiment, the disabling module 105 is used to disable a vibration function of the vibration device 40, when the detecting module 101 determines that the electronic device 1 is in the voice recording mode. When the vibration function is disabled, the vibration device 40 cannot vibrate and produce the noise.

The activating module 106 is used to activate the vibration function of the vibration device 40, when the detecting module 101 determines that the electronic device lexits the voice recording mode. In the embodiment, when the detecting module 101 detects that the application running a voice recording function is disabled or the voice recording function in the application is disabled, the detecting module 101 determines that the electronic device 1 exits the voice recording mode.

The determining module 103 further determines whether the electronic device 1 is activated to transmit the speaking voices of at least one user to a receiver. The transmission module 107 is used to transmit the speaking voices of at least one user without the noises produced by the vibration device 40 to the receiver, when the determining module 103 determines that the electronic device 1 is activated to transmit the speaking voices of at least one user to a receiver.

Figure 2:
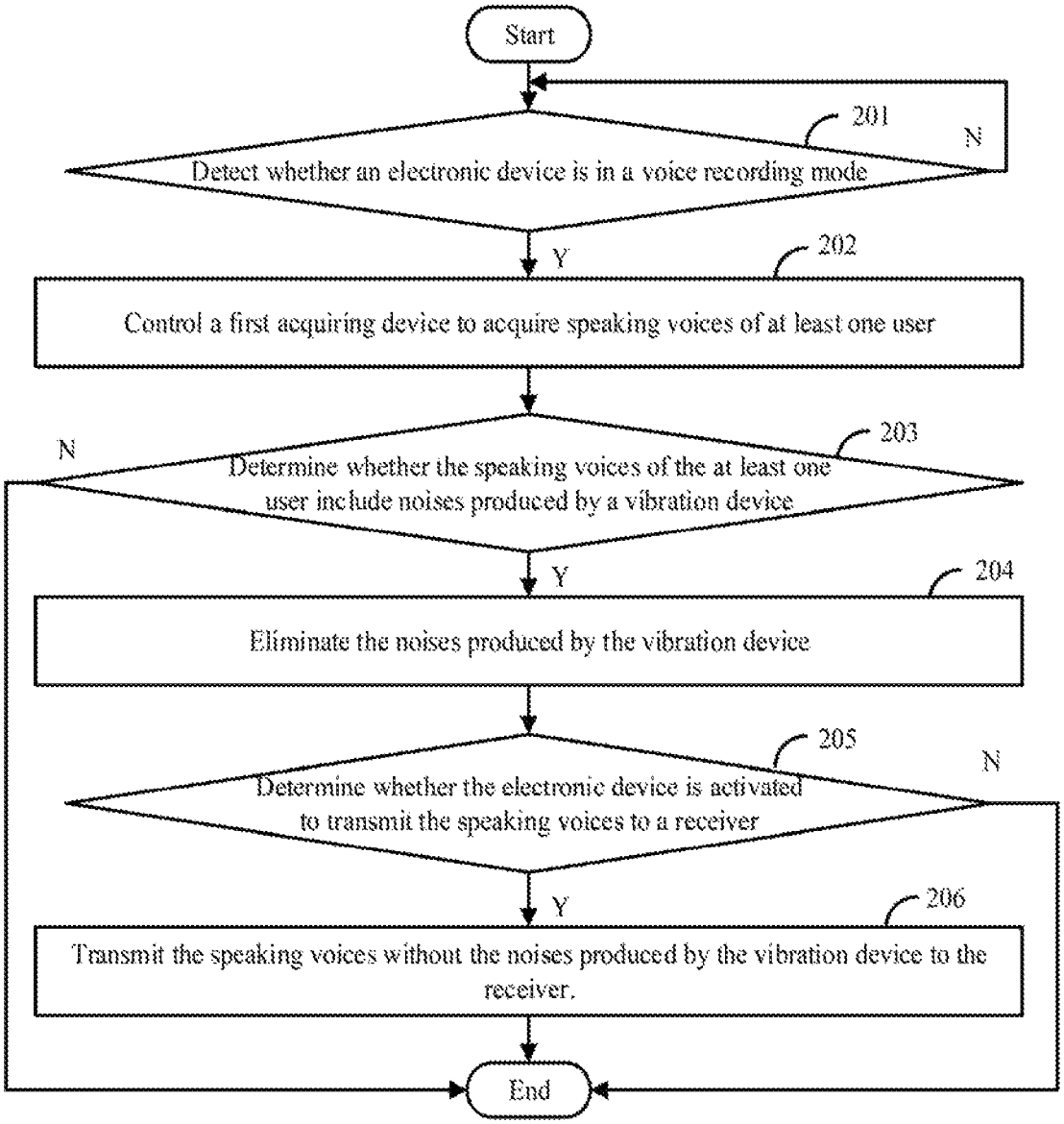
FIG. 2 illustrates a flowchart of an embodiment of a method for eliminating noises from recordings.

FIG. 2 illustrates a flowchart of an embodiment of a method for eliminating noises from recordings. The method is provided by way of example, as there are a variety of ways to carry out the method. The method described below can be carried out using the configurations illustrated in FIG. 1, for example, and various elements of these figures are referenced in explaining the example method. Each block shown in FIG. 2 represents one or more processes, methods, or subroutines carried out in the example method. Furthermore, the illustrated order of blocks is by example only and the order of the blocks can be changed. Additional blocks may be added or fewer blocks may be utilized, without departing from this disclosure. The example method can begin at block 201.

At block 201, the detecting module 101 detects whether the electronic device 1 is in a voice recording mode. When the detecting module 101 detects that the electronic device 1 is in the voice recording mode, the process goes to block 202. When the detecting module 101 detects that the electronic device 1 is not in the voice recording mode, the process continues in block 201.

At block 202, the acquiring module 102 controls the first acquiring device 30 to acquire the speaking voices of at least one user.

At block 203, the determining module 103 determines whether the speaking voices of the at least one user acquired by the first acquiring device 30 include noises produced by the vibration device 40. When the determining module 103 determines that the speaking voices of at least one user acquired by the first acquiring device 30 include the noises produced by the vibration device 40, the process goes to block 204. When the determining module 103 determines that the speaking voices of at least one user acquired by the first acquiring device 30 do not include the noises produced by the vibration device 40, the process ends.

At block 204, the eliminating module 104 eliminates the noises produced by the vibration device 40.

At block 205, the determining module 103 further determines whether the electronic device 1 is activated to transmit the speaking voices to a receiver. When the determining module 103 determines that the electronic device 1 is activated to transmit the user voices to a receiver, the process goes to block 206. When the determining module 103 determines that the electronic device 1 is not activated to transmit the user voices to a receiver, the process ends.

At block 206, the transmission module 107 transmits the speaking voices of the at least one user without the noises produced by the vibration device 40 to the receiver.

In another embodiment, the method can include disabling a vibration function of the vibration device 40, when determining that the electronic device 1 is in the voice recording mode, and activating the vibration function of the vibration device 40, when determining that the electronic device 1 exits the voice recording mode.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being embodiments of the present disclosure.

What is claimed is:

1. An electronic device comprising:

at least one processor;

a first acquiring device coupled to the at least one processor;

a vibration device coupled to the at least one processor; and a storage device coupled to the at least one processor and storing instructions for execution by the at least one processor to cause the at least one processor to:

detect whether the electronic device is in a voice recording mode;

control, when the electronic device is in the voice recording mode, the first acquiring device to acquire speaking voices of at least one user;

determine whether speaking voice signals of the at least one user acquired by the first acquiring device include noises produced by the vibration device;

eliminate, when the speaking voice signals of the at least one user acquired by the first acquiring device include the noises produced by the vibration device, the noises produced by the vibration device;

enable subtraction of digital signals of the speaking voices of the at least one user mixed with digital signals of the noises acquired by the first acquiring device from digital signals of noises acquired by a second acquiring device; and amplify the digital signals of the speaking voices of the at least one user after the subtraction according to a multiple value of differential amplification.

2. The electronic device according to claim 1, wherein the at least one processor is further caused to:

determine whether the speaking voice signals of the at least one user acquired by the first acquiring device include the noises produced by the vibration device by determining whether the second acquiring device has acquired sound produced by the vibration device.

3. The electronic device according to claim 2, wherein the at least one processor is further caused to:

convert the speaking voice signals of the at least one user mixed with the noises to digital signals by the first acquiring device;

acquire the digital signals of the speaking voices of the at least one user mixed with the noises;

convert the noises produced by the vibration device to digital signals by the second acquiring device; and acquire the digital signals of the noises produced by the vibration device.

4. The electronic device according to claim 3, wherein the at least one processor is further caused to:

analyze the digital signals of the noises converted by the second acquiring device to determine an amplitude and a phase of the noises;

generate an audio signal with an amplitude which is equal to the determined amplitude of the noises and a phase which is contrary to the determined phase of the noises; and superimpose the generated audio signal over the digital signal of the noises thereby cancelling the digital signals of the noises mixed in the digital signals of speaking voices of the at least one user.

5. The electronic device according to claim 1, wherein the at least one processor is further caused to:

disable a vibration function of the vibration device when the electronic device is in the voice recording mode; and activate the vibration function of the vibration device, when the electronic device exits the voice recording mode.

6. The electronic device according to claim 1, wherein the at least one processor is further caused to:

determine whether the electronic device is activated to transmit the speaking voices of the at least one user to a receiver; and transmit the speaking voices of the at least one user without the noises produced by the vibration device to the receiver.

7. A method for eliminating noises from recordings applicable in an electronic device comprising:

detecting whether the electronic device is in a voice recording mode;

controlling a first acquiring device of the electronic device to acquire speaking voices of at least one user when the electronic device is in the voice recording mode;

determining whether speaking voice signals of the at least one user acquired by the first acquiring device include noises produced by a vibration device; and eliminating the noises produced by the vibration device, when the speaking voice signals of the at least one user acquired by the first acquiring device include the noises produced by the vibration device;

wherein a method of eliminating the noises produced by the vibration device comprises:

enabling subtraction of digital signals of the speaking voices of the at least one user mixed with digital signals of the noises acquired by the first acquiring device from digital signals of noises acquired by a second acquiring device; and amplifying the digital signals of the speaking voices of the at least one user after the subtraction according to a multiple value of differential amplification.

8. The method according to claim 7, wherein a method of determining whether the speaking voice signals of the at least one user acquired by the first acquiring device include the noises produced by the vibration device comprises:

determining whether the second acquiring device has acquired sound produced by the vibration device.

9. The method according to claim 8, wherein the method of eliminating the noises produced by the vibration device comprises:

converting the speaking voice signals of the at least one user mixed with the noises to digital signals by the first acquiring device;

acquiring the digital signals of the speaking voices of the at least one user mixed with the noises;

converting the noises produced by the vibration device to digital signals by the second acquiring device; and acquiring the digital signals of the noises produced by the vibration device.

10. The method according to claim 9, wherein the method of eliminating the noises produced by the vibration device further comprises:

analyzing the digital signals of the noises converted by the second acquiring device to determine an amplitude and a phase of the noises;

generating an audio signal with an amplitude which is equal to the determined amplitude of the noises and a phase which is contrary to the determined phase of the noises; and superimposing the generated audio signal over the digital signal of the noises thereby cancelling the digital signals of the noises mixed in the digital signals of speaking voices of the at least one user.

11. The method according to claim 7, further comprising:

disabling a vibration function of the vibration device when the electronic device is in the voice recording mode; and activating the vibration function of the vibration device when the electronic device exits the voice recording mode.

12. The method according to claim 7, further comprising:

determining whether the electronic device is activated to transmit the speaking voices of the at least one user to a receiver; and transmitting the speaking voices of the at least one user without the noises produced by the vibration device to the receiver.

13. A non-transitory storage medium having instructions stored thereon, when the instructions are executed by a processor of an electronic device, the processor is configured to perform a method for eliminating noises from recordings, wherein the method comprises:

detecting whether the electronic device is in a voice recording mode;

controlling a first acquiring device of the electronic device to acquire speaking voices of at least one user when the electronic device is in the voice recording mode;

determining whether speaking voice signals of the at least one user acquired by the first acquiring device include noises produced by a vibration device; and eliminating the noises produced by the vibration device, when the speaking voice signals of the at least one user acquired by the first acquiring device include the noises produced by the vibration device;

wherein a method of eliminating the noises produced by the vibration device comprises:

enabling subtraction of digital signals of the speaking voices of the at least one user mixed with digital signals of the noises acquired by the first acquiring device from digital signals of noises acquired by a second acquiring device; and amplifying the digital signals of the speaking voices of the at least one user after the subtraction according to a multiple value of differential amplification.

14. The non-transitory storage medium according to claim 13, wherein a method of determining whether the speaking voice signals of the at least one user acquired by the first acquiring device include the noises produced by the vibration device comprises:

determining whether the second acquiring device has acquired sound produced by the vibration device.

15. The non-transitory storage medium according to claim 14, wherein the method of eliminating the noises produced by the vibration device comprises:

converting the speaking voice signals of the at least one user mixed with the noises to digital signals by the first acquiring device;

acquiring the digital signals of the speaking voices of the at least one user mixed with the noises;

converting the noises produced by the vibration device to digital signals by the second acquiring device; and acquiring the digital signals of the noises produced by the vibration device.

16. The non-transitory storage medium according to claim 15, wherein the method of eliminating the noises produced by the vibration device further comprises:

analyzing the digital signals of the noises converted by the second acquiring device to determine an amplitude and a phase of the noises;

generating an audio signal with an amplitude which is equal to the determined amplitude of the noises and a phase which is contrary to the determined phase of the noises; and superimposing the generated audio signal over the digital signal of the noises thereby cancelling the digital signals of the noises mixed in the digital signals of speaking voices of the at least one user.

17. The non-transitory storage medium according to claim 13, further comprising:

disabling a vibration function of the vibration device when the electronic device is in the voice recording mode; and activating the vibration function of the vibration device when the electronic device exits the voice recording mode.

18. The non-transitory storage medium according to claim 13, further comprising:

determining whether the electronic device is activated to transmit the speaking voices of the at least one user to a receiver; and transmitting the speaking voices of the at least one user without the noises produced by the vibration device to the receiver.

* * * * *